US009410364B1

(12) United States Patent
Zheng

(10) Patent No.: US 9,410,364 B1
(45) Date of Patent: Aug. 9, 2016

(54) SEALED MAGNETIC-CONTROLLED WINDOW BLIND BETWEEN TWO PANES OF GLASS

(71) Applicant: Supreme Plastic Products Co., Ltd., Guangdong (CN)

(72) Inventor: Song-Li Zheng, Guangdong (CN)

(73) Assignee: Supreme Plastic Products Co., Ltd., Qingyuan, Guangdong (CN)

( * ) Notice: Subject to any disclaimer, the term of this patent is extended or adjusted under 35 U.S.C. 154(b) by 0 days.

(21) Appl. No.: 14/859,212

(22) Filed: Sep. 18, 2015

(51) Int. Cl.
*E06B 9/264* (2006.01)
*E06B 9/322* (2006.01)
*E06B 7/12* (2006.01)

(52) U.S. Cl.
CPC . *E06B 9/264* (2013.01); *E06B 7/12* (2013.01); *E06B 9/322* (2013.01); *E06B 2009/2643* (2013.01); *E06B 2009/2646* (2013.01)

(58) Field of Classification Search
CPC ..... E06B 2009/2646; E06B 2009/2643; E06B 7/12
USPC ..... 160/107, 168.1 R, 176.1 R, 170, 171, 160/DIG. 16
See application file for complete search history.

(56) References Cited

U.S. PATENT DOCUMENTS

| | | | | |
|---|---|---|---|---|
| 6,601,633 | B2 * | 8/2003 | Sun | E06B 9/264 160/107 |
| 7,000,670 | B2 * | 2/2006 | Kwon | E06B 9/264 160/107 |
| 7,475,715 | B2 * | 1/2009 | Gardner | E06B 9/264 160/107 |
| 7,669,633 | B2 * | 3/2010 | Berger | E06B 9/264 160/107 |
| 8,499,815 | B2 * | 8/2013 | Zhang | E06B 9/264 160/107 |
| 8,550,141 | B2 * | 10/2013 | Ding | E06B 9/264 160/107 |
| 2006/0118250 | A1 * | 6/2006 | Jin | E06B 9/264 160/107 |

* cited by examiner

*Primary Examiner* — David Purol
(74) *Attorney, Agent, or Firm* — Yuwen Guo

(57) ABSTRACT

A sealed magnetic-controlled window blind between two panes of glass is disclosed. Raising or lowering the window blind which is sealed between two panes of glass is performed by the magnetic attraction between the between the raising outside control set and the raising inside control set (the magnets may be used). In addition, the operation of raising or lowering the window blind may be smooth due to the arrangement of the pulleys (or bearing) which are arranged on the raising inside control set and the outside control set.

3 Claims, 3 Drawing Sheets

SEALED MAGNETIC-CONTROLLED WINDOW BLIND BETWEEN TWO PANES OF GLASS

FIELD OF THE INVENTION

The present invention relates to a sealed magnetic-controlled window blind between two panes of glass.

BACKGROUND OF THE INVENTION

There are three kinds of the conventional magnetic-controlled window blinds. The first kind of the conventional magnetic-controlled window blinds is that the light modulation device and the raising device are separated. The light modulation device is mounted at a top portion of the window blind. The raising device is mounted at a left side or a right side of the window blind. The disadvantage is that the light modulation device is hard to be operated while the window blind is too high.

The second kind thereof is that the light modulation device and the raising device are mounted at the left side and the right side of the window blind respectively. The disadvantage is that the user must move to different sides to operate the light modulation device and the raising device which are mounted at the left side and the right side of the window blind. It is inconvenient.

The third kind thereof is that the light modulation device is integrated with the raising device. That is, the light modulation device is assembled with the raising device, and an outside control bar is exposed outside to control them for performing light modulation, raising and lowering the window blind. Because the leaves are closed, the pull cord will rub against the aluminum plate while raising the window blind. There will be much dust staying on the pull cord and the leaves and the window blind may become dirty.

Accordingly, the inventor of the present invention has devoted himself based on his many years of practical experiences to solve this problem.

SUMMARY OF THE INVENTION

The object of the present invention is to provide a sealed magnetic-controlled window blind between two panes of glass. Raising or lowering the window blind which is sealed between two panes of glass is performed by the magnetic attraction between the between the raising outside control set and the raising inside control set (the magnets may be used). In addition, the operation of raising or lowering the window blind may be smooth due to the arrangement of the pulleys (or bearing) which are arranged on the raising inside control set and the outside control set.

The sealed magnetic-controlled window blind between two panes of glass may comprise a blind body, a frame, and a control system. The bind body includes a head rail set, a pulley set, a plurality of leaves, a bottom rail, and a ladder cord. The frame includes an upper portion, a right side portion, a left side portion, a left side rail, a lower portion, and a lower rail. The upper portion, the right side portion, the left side portion, and the lower portion are connected with one another by corner connectors. The blind body is fastened to the upper portion through the head rail set. The left side portion and the left side rail are engaged with each other. The lower portion and the lower rail are engaged with each other. The lower rail and the left side rail have a U-shaped groove respectively, and the leaves are received in the U-shaped grooves to shield the light leakage between the leaves and the frame. The control system has a raising inside control set, a raising outside control set, a raising cord set, a light modulation inside control set, a gyroscope, a light modulation outside control set, a spring, a light modulation cord set, a corner set, an iron bar, an inner rail, and an outer rail. The corner set includes a light modulation wheel, a light modulation bearing, a corner body, a pulley, and a light modulation cover. The inner rail is fastened to the right side portion, and the outer rail is stuck to the glass.

One end of the raising cord set is fastened on the bottom rail, passing through at least one blind hole of the leaves and an iron core of the pulley set to turn an angle of 90 degree, turned an angle of 90 degree downwardly by the corner set, passing through the pulley arranged on the raising inside control set to turn an angle of 90 degree upwardly, and then fastened on the corner set.

One end of the light modulation cord set is fastened to a bottom end of the light modulation inside control set, the other end of the light modulation cord set is fastened to an upper end of the spring arranged under the light modulation cord set, a bottom end of the spring is fastened to the pull cord, the pull cord is extended downwardly to the gyroscope to turn an angle of 180 degree to extend upwardly, the pull cord is winded around the light modulation wheel with an angle of 180 degree to extended downwardly, and then the pull cord is fastened to a top end of the light modulation inside control set.

In some embodiments, a desiccant is arranged inside a sealed space, the sealed is defined in the left side portion and the lower portion so as to make sure that the sealed space is dry and prevent the glass from fogging.

In some embodiments, the outer rail is stuck to the glass by a double-side tape.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
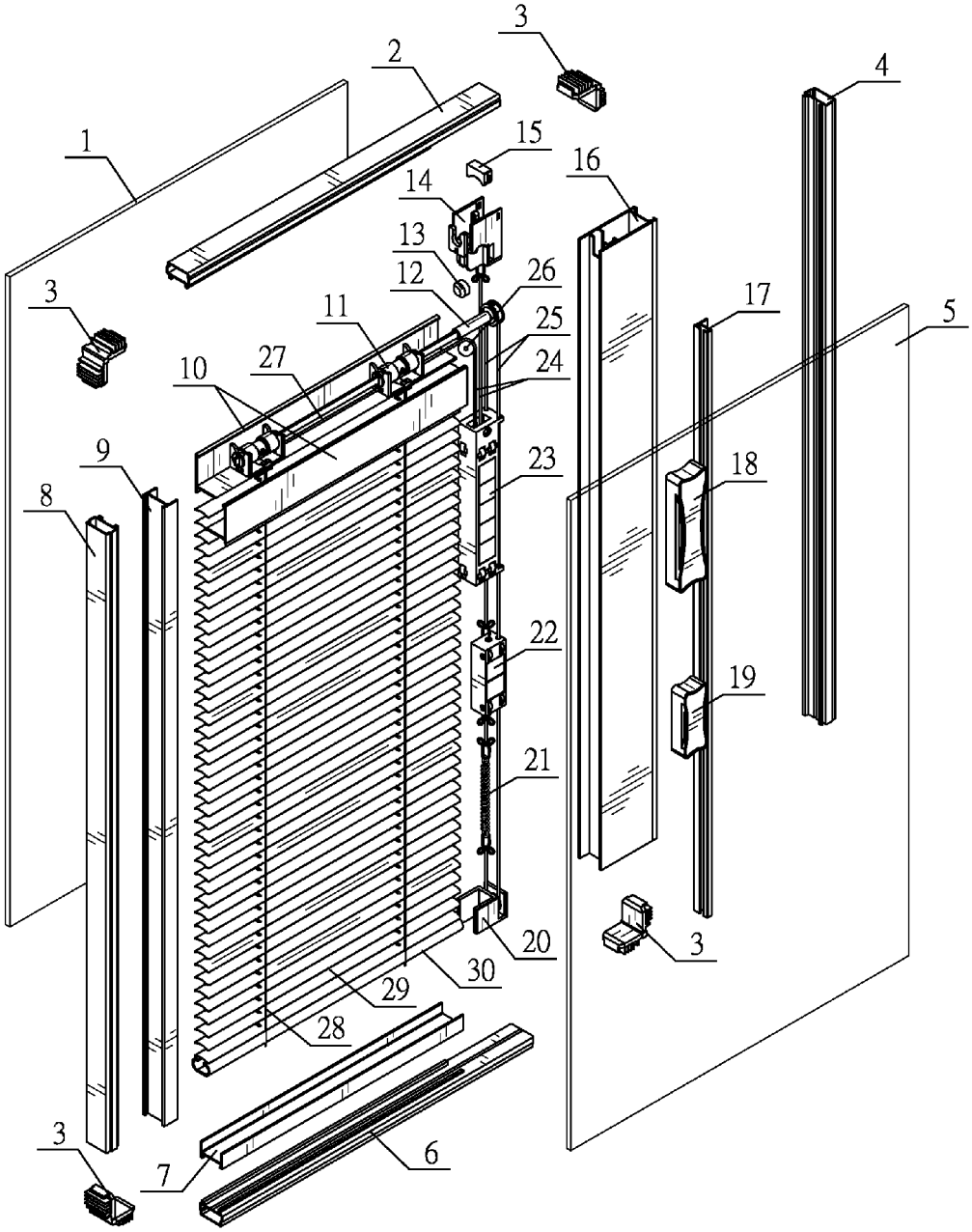
FIG. 1 is an exploded view of a sealed magnetic-controlled window blind between two panes of glass according to the present invention.

Referring now to the drawings where like characteristics and features among the various figures are denoted by like reference characters.

Figure 2:
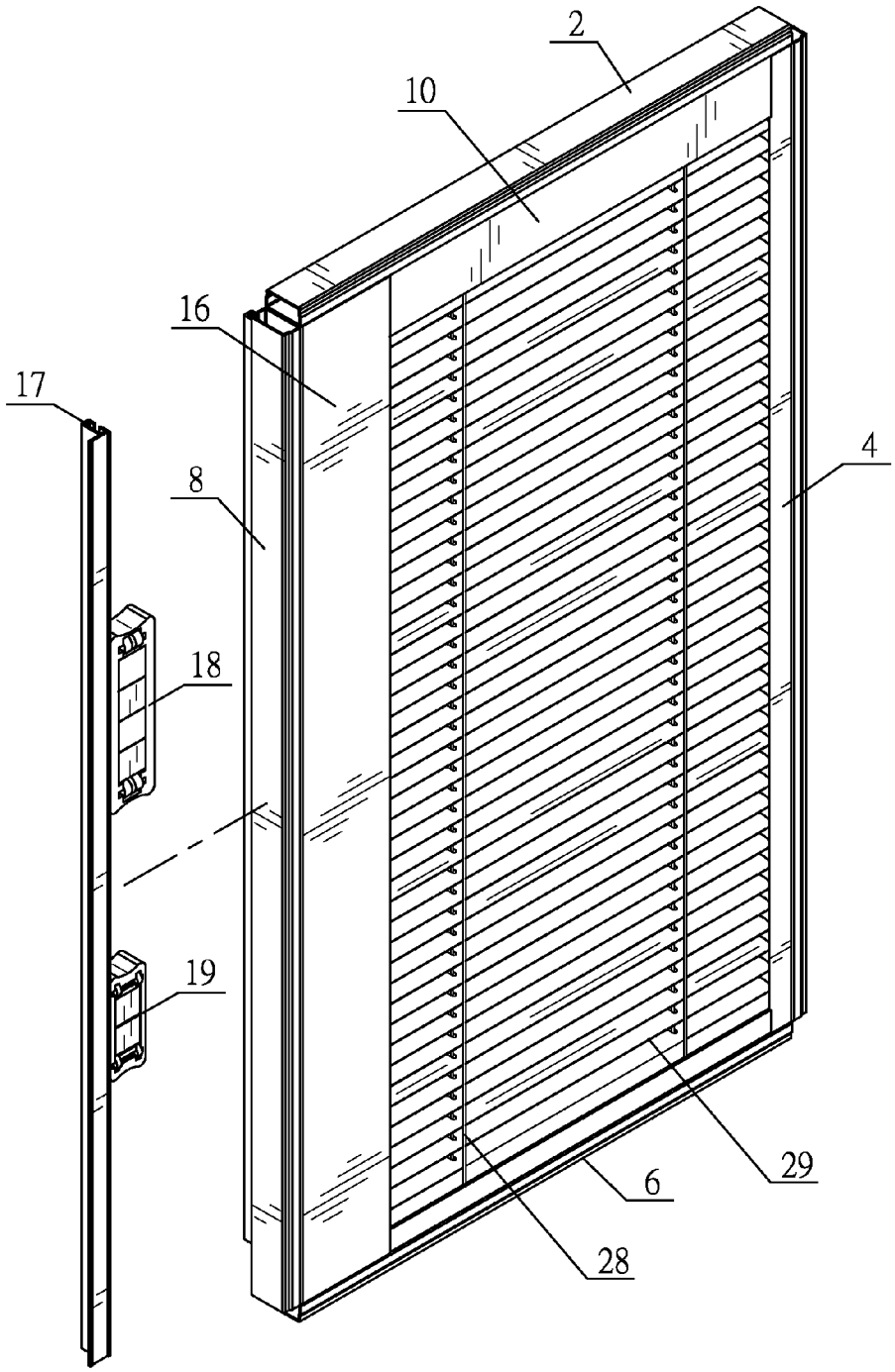
FIG. 2 is a partial exploded view of the sealed magnetic-controlled window blind between two panes of glass according to the present invention.
Figure 3:
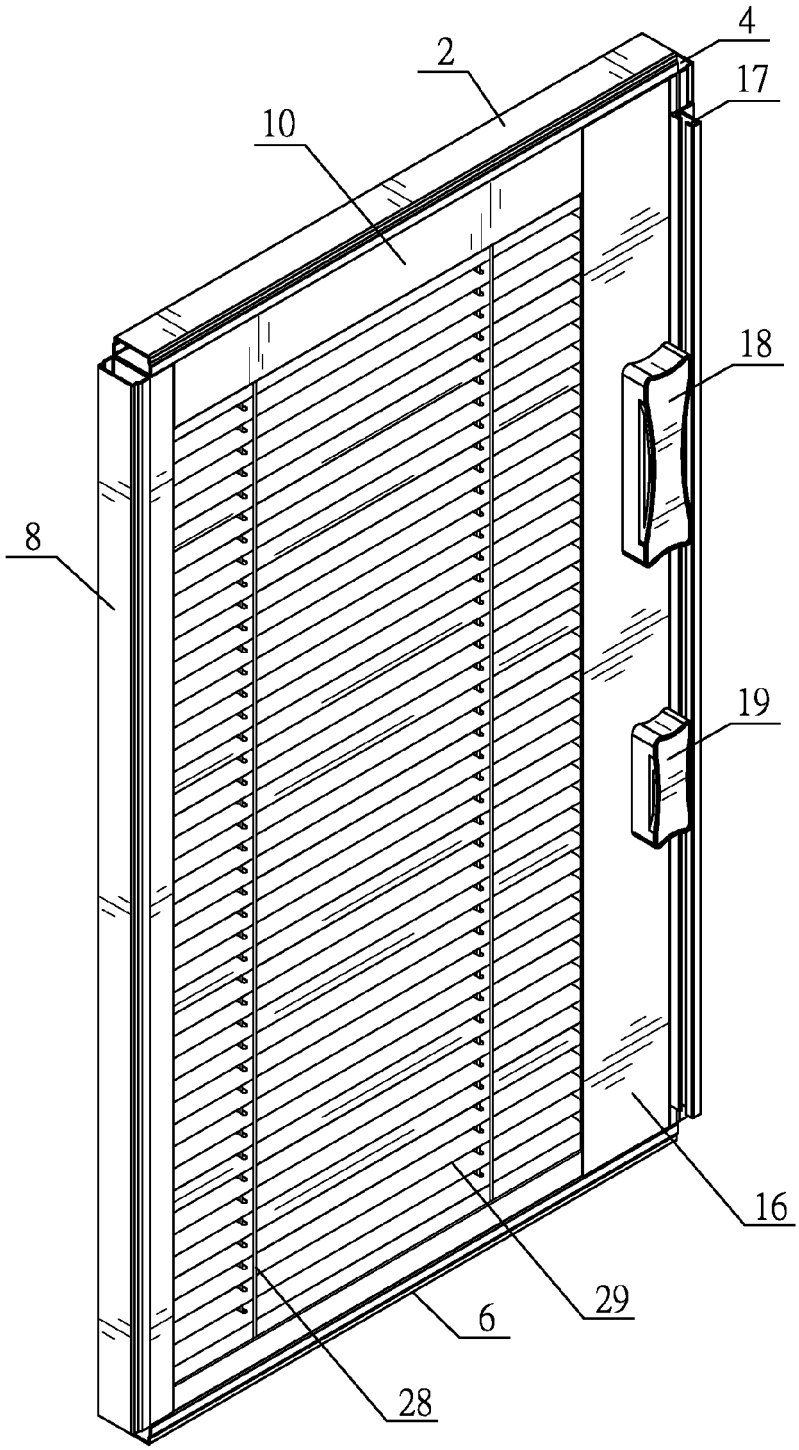
FIG. 3 is a perspective view of the sealed magnetic-controlled window blind between two panes of glass according to the present invention.

Please refer to FIGS. 1 to 3, the sealed magnetic-controlled window blind between two panes of glass according to the present invention comprises a blind body, a frame, and a control system.

The bind body includes a head rail set 10, a pulley set 11, a plurality of leaves 29, a bottom rail 30, and a ladder cord 28.

The frame includes an upper portion 2, a right side portion 4, a left side portion 8, a left side rail 9, a lower portion 6, and a lower rail 7. The upper portion 2, the right side portion 4, the left side portion 8, and the lower portion 6 are connected with one another by corner connectors. The blind body is fastened to the upper portion 2 of the frame through the head rail set. The left side portion 8 and the left side rail 9 may be engaged with each other. The lower portion 6 and the lower rail 7 may be engaged with each other. A desiccant may be arranged inside a sealed space which is defined in the left side portion 8 and the lower portion 6 so as to make sure that the sealed space is dry and prevent the glass from fogging. The lower rail 7 and the left side rail 9 have a U-shaped groove respectively. The leaves 29 may be received in the U-shaped grooves to shield the light leakage between the leaves 29 and the frame.

The control system comprises a raising inside control set 23, a raising outside control set 18, a raising cord set 24, a light modulation inside control set 22, a gyroscope 20, a light modulation outside control set 19, a spring 21, a light modulation cord set 25, a corner set, an iron bar 27, an inner rail 16, and an outer rail 17. The corner set includes a light modulation wheel 12, a light modulation bearing 13, a corner body 14, a pulley 26, and a light modulation cover 15. The inner rail 16 is fastened to the right side portion 4. The outer rail 17 is stuck to the glass by a double-side tape.

When raising the window blind, it may be performed by the inner rail 16, the raising cord set 24, and the corner set. The inner rail 16 and the outer rail 17 may make sure that the raising inside control set 13 and the raising outside control set 18 are only moved up and down but not left and right. One end of the raising cord set 24 is fastened on the bottom rail, passing through at least one blind hole of the leaves and the iron core of the pulley set 11 to turn an angle of 90 degree, turned an angle of 90 degree downwardly by the corner set, passing through the pulley which is arranged on the raising inside control set 13 to turn an angle of 90 degree upwardly, and then fastened on the corner set to form a combination of a fixed pulley (the pulley on the corner set) and a movable pulley (the pulley on the raising inside control set 13). When the raising outside control set 18 is moved on the outer rail 17 downwardly, the raising inside control set 13 is moved with the raising outside control set 18 downwardly due to the magnetic attraction between the raising outside control set 18 and the raising inside control set 13. The pull cord which is arranged inside the inner rail 16 is moved downwardly due to the downward movement of the raising inside control set 13 so as to raise the window blind. When the raising outside control set 18 is moved upwardly, the raising inside control set 13 is also moved upwardly due to the magnetic attraction. The pull cord which is arranged in the inner rail 16 is released and the sides of the window blind are moved downwardly due to the gravity of the leaves and the bottom rail. According to above mentioned structure and operation, raising or lowering the window blind which is sealed between two panes of glass is performed by the magnetic attraction between the between the raising outside control set 18 and the raising inside control set 13 (the magnets may be used). In addition, the operation of raising or lowering the window blind may be smooth due to the arrangement of the pulleys (or bearing) which are arranged on the raising inside control set 13 and the outside control set 17. The raising outside control set 18 may have a T-shaped buckle which may cooperate with a T-shaped groove of the outer rail 17 to make sure that the raising outside control set 18 is moved along a direction of the outer rail 17.

A light modulation system of the window blind comprises the light modulation inside control set 22, the gyroscope 20, the light modulation outside control set 19, the spring 21, the light modulation cord set 25, the corner set, the iron bar 27, the inner rail 16, and the outer rail 17. One end of the light modulation cord set 25 is fastened to a bottom end of the light modulation inside control set 22, the other end of the light modulation cord set 25 is fastened to an upper end of the spring 21 which is arranged under the light modulation cord set 25, a bottom end of the spring 21 is fastened to the pull cord, the pull cord is extended downwardly to the gyroscope 20 to turn an angle of 180 degree to extend upwardly, the pull cord is winded around the light modulation wheel 12 with an angle of 180 degree to extended downwardly, and then the pull cord is fastened to a top end of the light modulation inside control set 22 to form a light modulation circulation. The magnets may be arranged at the light modulation inside control set 22 and the light modulation outside control set 19. When the light modulation outside control set 19 is moved up and down, the light modulation inside control set 22 is moved with the light modulation outside control set 19 up and down and drives the pull cord to move. The light modulation wheel 12 is driven by the pull cord to rotate through the light modulation cord set 25, the iron bar 27 is driven by the light modulation wheel 12 to rotate, the pulley set 11 is driven by the iron bar 27 to rotate, and then the ladder cord 28 is driven by the pulley set 11 to perform the function of light modulation. Besides, the operation of raising or lowering the window blind may be smooth due to the arrangement of the pulleys (or bearing) which are arranged on the raising inside control set 13 and the outside control set 17. The spring 21 may make sure that the tension of the pull cord is enough. The bearing 13 may make sure that the light modulation is smooth. The light modulation cover 15 may make sure that the pull cord will not be separated. The light modulation inside control set 22 and the light modulation outside control set 19 may be arranged at an upper end or a lower end of the raising inside control set 13 and the raising outside control set 17 if necessary.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A sealed magnetic-controlled window blind between two panes of glass, comprising a blind body, a frame, and a control system, wherein:

the bind body includes a head rail set, a pulley set, a plurality of leaves, a bottom rail, and a ladder cord;

the frame includes an upper portion, a right side portion, a left side portion, a left side rail, a lower portion, and a lower rail, the upper portion, the right side portion, the left side portion, and the lower portion are connected with one another by corner connectors, the blind body is fastened to the upper portion through the head rail set, the left side portion and the left side rail are engaged with each other, the lower portion and the lower rail are engaged with each other, the lower rail and the left side rail have a U-shaped groove respectively, and the leaves are received in the U-shaped grooves to shield the light leakage between the leaves and the frame; and the control system has a raising inside control set, a raising outside control set, a raising cord set, a light modulation inside control set, a gyroscope, a light modulation outside control set, a spring, a light modulation cord set, a corner set, an iron bar, an inner rail, and an outer rail, the corner set includes a light modulation wheel, a light modulation bearing, a corner body, a pulley, and a light modulation cover, the inner rail is fastened to the right side portion, and the outer rail is stuck to the glass;

wherein one end of the raising cord set is fastened on the bottom rail, passing through at least one blind hole of the leaves and an iron core of the pulley set to turn an angle of 90 degree, turned an angle of 90 degree downwardly by the corner set, passing through the pulley arranged on the raising inside control set to turn an angle of 90 degree upwardly, and then fastened on the corner set; and wherein one end of the light modulation cord set is fastened to a bottom end of the light modulation inside control set, the other end of the light modulation cord set is fastened to an upper end of the spring arranged under the light modulation cord set, a bottom end of the spring is fastened to the pull cord, the pull cord is extended downwardly to the gyroscope to turn an angle of 180 degree to extend upwardly, the pull cord is winded around the light modulation wheel with an angle of 180 degree to extended downwardly, and then the pull cord is fastened to a top end of the light modulation inside control set.

2. The window blind as claimed in claim 1, wherein a desiccant is arranged inside a sealed space, the sealed is defined in the left side portion and the lower portion so as to make sure that the sealed space is dry and prevent the glass from fogging.

3. The window blind as claimed in claim 1, wherein the outer rail is stuck to the glass by a double-side tape.

* * * * *